US006488564B1

(12) United States Patent
Gray

(10) Patent No.: US 6,488,564 B1
(45) Date of Patent: Dec. 3, 2002

(54) BRASSIERE PROTECTING AGAINST ELETROSTATIC FIELD INDUCED TISSUE DEGRADATION

(76) Inventor: James R. Gray, 8816 Westwood Ave., Little Rock, AR (US) 72204

( * ) Notice: Subject to any disclaimer, the term of this patent is extended or adjusted under 35 U.S.C. 154(b) by 0 days.

(21) Appl. No.: 09/517,081

(22) Filed: Mar. 1, 2000

Related U.S. Application Data

(60) Provisional application No. 60/122,362, filed on Mar. 2, 1999.

(51) Int. Cl.[7] ..... A41C 3/00
(52) U.S. Cl. ..... 450/57; 450/1
(58) Field of Search ..... 450/1, 30–32, 450/53–57, 93; 2/2.5, 463, 464, 468, 48, 46, 50, 51, 243.1, 267; 174/35 R, 356 C, 25 MC; 361/816, 818; 250/505.1, 515.1, 516.1, 519.1

(56) References Cited

U.S. PATENT DOCUMENTS 4,422,483 A 12/1983 Zins
4,471,015 A * 9/1984 Ebneth et al. ..... 174/35 R
4,490,433 A 12/1984 Shigeru et al.
4,590,623 A 5/1986 Kitchman
4,684,762 A * 8/1987 Gladfelter ..... 174/36
4,703,133 A * 10/1987 Miller ..... 361/816
4,825,877 A 5/1989 Kempe
5,008,594 A 4/1991 Swanson et al.
5,017,876 A 5/1991 Wright et al.
5,073,984 A * 12/1991 Tone et al. ..... 2/DIG. 7
5,621,188 A 4/1997 Lee et al.
5,690,537 A 11/1997 Kalmus

* cited by examiner

*Primary Examiner*—Gloria M. Hale
(74) *Attorney, Agent, or Firm*—Stephen D. Carver

(57) ABSTRACT

Breast support and other breast area covering articles are provided that protect from detrimental interaction of electrostatic fields with breast area tissue. In a preferred embodiment, electrically conductive electrostatic field-concentrators are adapted to ionize air molecules and cancel electrostatic charges in the vicinity to help prevent detrimental electrostatic field influence on breast area tissue of the wearer.

30 Claims, 5 Drawing Sheets

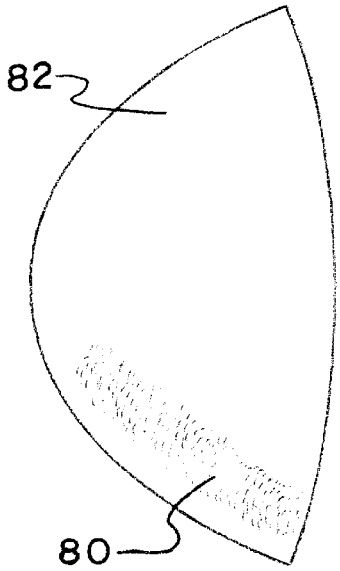
FIG. 14
FIG 13
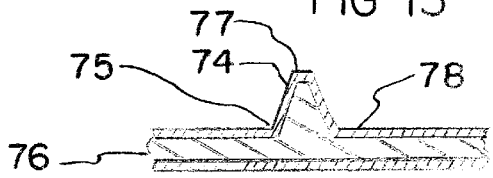
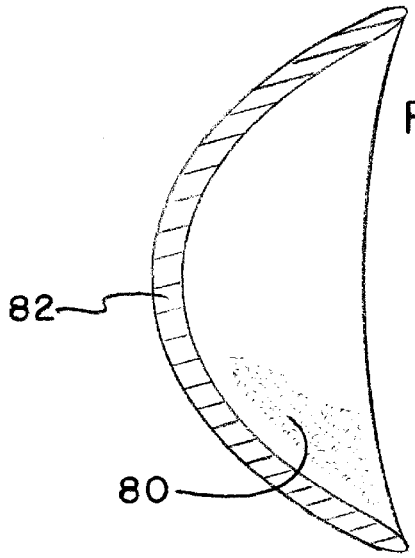
FIG. 15
FIG. 16
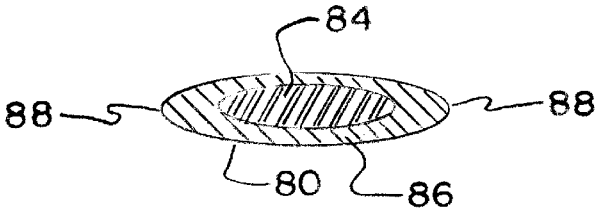

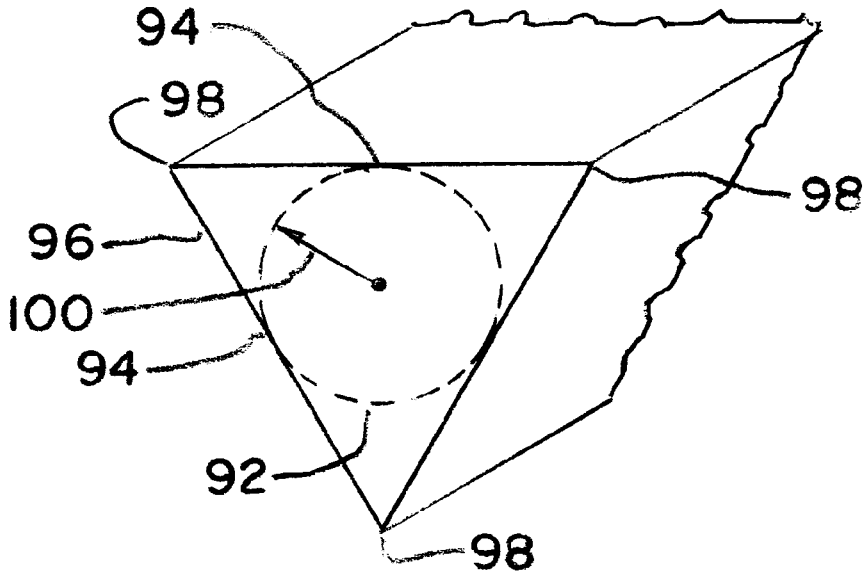
FIG. 17
FIG. 18
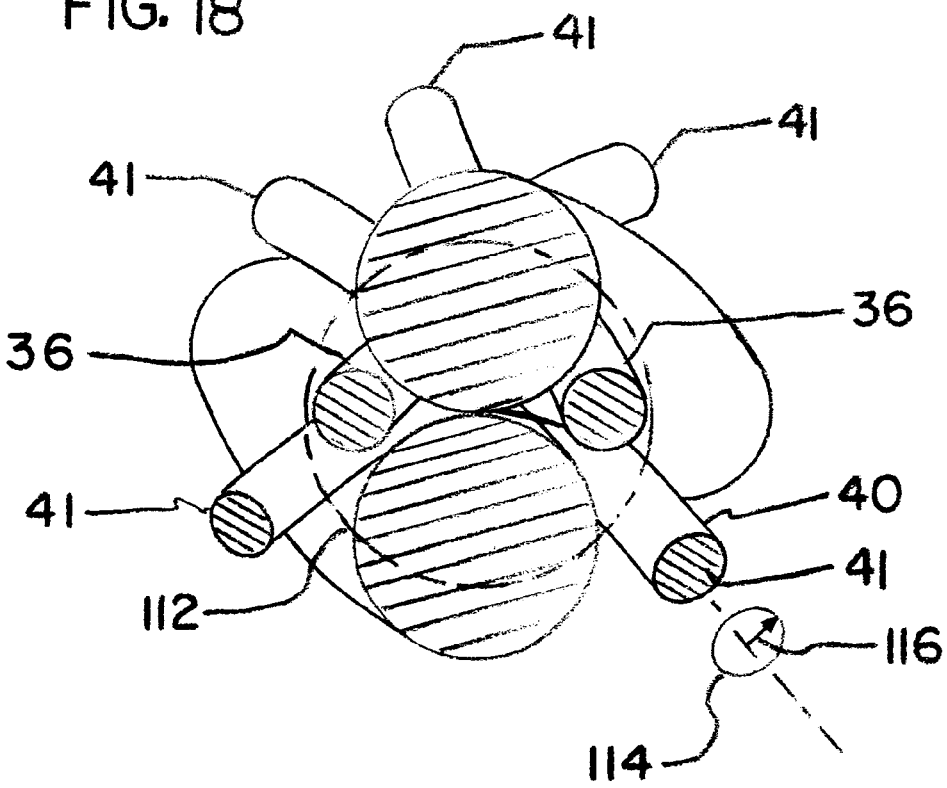

BRASSIERE PROTECTING AGAINST ELETROSTATIC FIELD INDUCED TISSUE DEGRADATION

CROSS REFERENCE TO RELATED APPLICATION

This application claims the benefit of Provisional Patent Application Ser. No. 60/122,362, filed Mar. 2, 1999, and the filing date thereof.

BACKGROUND OF THE INVENTION

I. Field of the Invention

The present invention relates generally to female breast support articles. More particularly the invention relates to breast area covering articles that minimize detrimental influence of electrostatic fields on breast area tissue.

II. Description of the Prior Art

The female breast is susceptible to several diseases of unknown origin. Worst among these diseases is breast cancer. There has been a huge, and unexplained, increase in breast cancer incidence in United States females over the past 20 years. Also, the rate of incidence continues to increase. A female in the United States today is 2.7 times more likely to incur breast cancer than her great grandmother was, and this is despite the beneficial diet and lifestyle changes that have occurred. The cause of this increase in breast cancer has not been understood, but the rate of increased cancer incidence in general is so large that the United States Department of Health and Human Services has speculated that "U.S. citizens face a growing cancer risk from some as yet unidentified environmental factors".

The inventor has discovered, and conducted numerous rodent studies to confirm, that exposure to environmental electrostatic fields (different from environmental electromagnetic fields) can directly promote cancer growth, and can also strongly increase the detrimental affect of chemicals on living tissue. This affect may be a large factor in the increased cancer incidence rates the U.S. is experiencing. Modern synthetic materials commonly used in the U.S., for example a nylon bra rubbing against a polyester blouse, can easily generate thousands of volts of electrostatic charge. Then, because of the extensive use of air-conditioning, which keeps humidity levels low, electrostatic fields from this charge can connect with the breast tissue for hours at a time. Methods of protecting breast and adjacent tissue from detrimental effects caused by exposure to electrostatic fields forms the basis of the present invention.

It is known that magnetic fields, and the magnetic portion of electromagnetic fields, can easily penetrate living tissue. This has been of concern over the past 18 years, with many studies conducted to evaluate the possibility of a causal link between electromagnetic fields and cancer. Yet, despite these years of research, very little affect from exposure to electromagnetic fields has been confirmed. Recent large studies in this area have again found no risk from exposure to these fields at the levels we commonly encounter them (Panel Finds EMF's Pose No Threat, Science 274:910, 1996, and Magnetic Field-Cancer Link: Will It Rest In Peace?, Science 277:29, 1997).

On the other hand, little consideration has been given to the possibility of electrostatic fields (which are different from electromagnetic fields) exerting influence inside a living body. The electrostatic charges which produce these fields commonly occur when two materials rub together, for example when our clothing rubs together or against another surface. Even rubbing natural materials together creates electrostatic fields, but usually at lower levels than synthetic materials. As a result, humans are almost constantly exposed to electrostatic fields in our normal environment everyday. Also, the field influence is typically very strong because of the close proximity of the charges to the body. For example, under conditions of low ambient humidity, rubbing a shirt sleeve against a shirt, getting up from a chair, walking across a floor, can generate charges with potentials in the 30,000 volt range; however voltages in the 5,000 to 15,000 volt range are more common. Lower electrostatic potentials are almost always present around a person, even with moderate to high humidity.

However, unlike electromagnetic fields, electrostatic fields do not have a magnetic component and do not oscillate, so they have been assumed incapable of having influence inside living tissue. Quite to the contrary, the inventor has conducted numerous studies, using live animals, which leave no doubt that electrostatic fields can exert strong, and detrimental, influence inside living tissue.

As a result of the assumption that electrostatic fields do not have biological effects inside living organisms, there has been little research in the field. Several non-biological effects are known, however, and they have led to techniques for reducing electrostatic charges in certain situations.

One example of an undesirable non-biological effect of electrostatic fields is a tendency for a person who walks across a carpet when the humidity is low to generate and store electrostatic charges on the body. These charges can then be discharged into a computer or other piece of equipment that is touched, resulting in damage to the equipment. It is known that this problem can be reduced by coating the carpet fibers with an anti-static compound or by incorporating conductive materials within the carpet in order to allow charges to quickly flow back together, or to ground, as the carpet is walked upon. U.S. Pat. No. 4,490,433 is an example of this technology.

Another undesirable non-biological effect is that the field from an electrostatic discharge may ruin modern electronic components during equipment manufacture. Some semiconductor devices can be damaged by an electrostatic discharge as low as 30 volts, and as a result the electronics industry is a leader in using the broadest range of electrostatic charge prevention methods. The Electrostatic Discharge Association, 200 Liberty Plaza, Rhome, N.Y. 13440, an electronics industry association "dedicated to advancing the theory and practice of electrostatic discharge avoidance", has many publications available on electrostatic charge generation, elimination, and test standards for the electronics industry. One known technique for reducing damage from electrostatic discharge is for assembly workers and others who handle sensitive components to wear conductive work garments (such as lab coats or jump suits) with grounding leads to drain off electrostatic charges. Similarly, conductive lab coats, etc., are used to prevent electrostatic sparks in areas where explosive gases are present. U.S. Pat. Nos. 4,422,483 and 4,590,623 show examples of this technology.

Another technique for reducing damage from electrostatic discharge is to use ion generators to cancel electrostatic charges on surfaces. Generators of this type use high-voltage corona discharge, or nuclear (alpha particle) energy, to ionize air molecules. These systems typically produce and blow negative and positive ions into the air, where they are attracted to combine with and cancel electrostatic charges in the vicinity. U.S. Pat. Nos. 5,008,594 and 5,017,876 show examples of this technology.

Attempts to protect the body from electric fields in general are also shown in the prior art. The methods generally involve covering the body area desired to be protected with a shielding layer in the form of metal or other conductive material. UK patent GB 2,025,237, and U.S. Pat. Nos. 4,825,877, 5,621,188 and 5,690,537, show examples of this technology. Some of these references principally address shielding electromagnetic fields, which are completely different from static electric fields. The references that mention electrostatic fields make the erroneous assumption that a conductive shielding layer will stop electrostatic field influence as well as it does electromagnetic field influence.

The requirements for preventing influence from electrostatic fields are totally different than that required for electromagnetic fields. A conductive shielding layer will block passage of an electromagnetic field because as the oscillating field impacts the conductive layer it induces currents that produce electric and magnetic fields in the layer. As these fields are created, they reinforce the electromagnetic field on the incident side of the layer, but are out of phase with, and oppose and cancel, the field on the other side of the layer.

To the contrary, simply placing a conductive layer between an electrostatic charge and a body area to be protected will not stop electrostatic field influence from reaching the body. Electrostatic fields do not oscillate so they do not produce oscillating electric current that opposes the impacting field. The passage of electrostatic fields through a conductive material is shown by the physics "Superposition Principle" which states that "The net electric force on a charged object is the vector sum of the individual electric forces on the object due to all other charged objects. Each individual interaction is unaffected by the presence of other charges". A good explanation of this principle and its ramifications can be found in the book *Electric & Magnetic Interactions,* R. W. Chabay and B. A. Sherwood, John Wiley & Sons publishers, 1995. As shown by the Superposition Principle, the presence of conductive material between an electrostatic charge and an object (the human body for example) does not stop electrostatic field influence from reaching the object.

This can be demonstrated by placing a solid aluminum or steel plate between a piece of charged cloth and an electrostatic field meter, with the meter serving as the body area to be protected. Even a 2.5-cm (1-inch) thick intervening conductive plate will at best reduce the field influence by only around one-half to two-thirds. It does not stop the field and its influence is still detected by the electrostatic field meter (body). We of course cannot wear 2.5-cm thick steel plates on our body, but even reducing common electrostatic field intensity by two-thirds cannot be expected to protect the body from detrimental electrostatic field influence. For example, a 5,000 volt electrostatic charge (which is common) on a 1-cm diameter area of a clothing article 0.5-mm from the body of the article wearer exposes the body area next to the charge to an electrostatic field intensity of over 900,000 volts per meter (V/m). Reducing this field by even two-thirds would still expose the body to a field intensity of 300,000 V/m. The inventor's animal studies have shown that an electrostatic field just one-fourth as intense as 300,000 V/m can strongly promote cancer growth.

Also, electrically connecting an intervening conductive plate, or other conductive material as noted in the prior art, to the body of a wearer, cannot be counted on to stop electrostatic field influence. Electrically, this simply creates a static conductive object (the conductive material) in contact with a dynamic conductive object (the body of the wearer) so that one side each of the combination of static object/conductive object is exposed. Electrostatic field influence will then pass through the static conductive object and dynamic conductive object as it continually tries to bring the charges in each to a point of static equilibrium.

It is also important to note that wearing a protective article that simply drains static electric charges cannot be counted on to stop electrostatic field influence. For example, if a woman wore bra incorporating an electrically conductive material to simply drain static electric charges from the bra to the body, charges would be removed from the bra surface. However if a blouse or other nonconductive article worn next to the bra became charged, these charges would not be removed. Electrostatic field influence from these charges would then pass through the bra and connect with the breast tissue. This also would not protect the conductive bra wearer's breast tissue from static electric fields generated on other nearby clothing articles, such as from charges generated as a blouse and sweater rub together for example.

In summary, although the prior art teaches conductive shielding placed next to the body (including the breast area), or dissipating static charge by draining, etc., the prior art does not teach breast support articles and other breast coverings that minimize detrimental influence of electrostatic fields on breast area tissue by creating air ions to cancel electrostatic charges at the source generating the fields on both the breast support article and other charged surfaces in the vicinity.

The inventor has used in vivo studies to conclusively demonstrate that electrostatic fields can exert strong influence inside a living body, directly affecting cell operation and also strongly increasing the detrimental effect of chemicals on cells. Protecting the female breast area, which is particularly prone to cell damage, from these fields is very important. This can result in reduced breast disease, and lives saved.

The inventor has conducted animal studies that demonstrate that electrostatic fields can strongly influence cells inside living tissue, and has shown a direct connection between these fields and cancer growth. These are the same fields created when our clothes rub together or against other surfaces and create the static electric charges that generate electrostatic fields. All commonly used clothing material can generate electrostatic charges and fields, but popular synthetics like polyester, nylon, acrylics, and polyolefins are much better electrostatic generators than materials from natural fibers.

Wearing two layers of clothes can further enhance the generation and trapping of electrostatic charges, and thus increases exposure of nearby body areas to electrostatic fields from these charges. Significantly, the areas of the human body where cancer incidence is increasing most are almost all areas where two layers of clothes are normally worn. In breast cancer for instance, almost two-thirds of the tumors occur in the upper/outer quadrant and nipple area of the breast, even though the tissue is substantially the same in the other quadrants. This is the exact area where a bra and outer garment, such as a blouse or jacket for example, are in most intimate contact and where the surfaces of the bra and outer garment, or the surfaces of other outer garments, rub together most during normal movement to generate static electric charges and thus fields.

The inventor's research as shown that the present invention is important in regard to cancer growth promotion, however it may well be just as important in regard to disease prevention. It is now known that more than half, and possibly as much as 80%, of all disease, ranging over such diverse areas as diabetes to cancer, is caused by genetic damage. The human genome in each cell is estimated to contain over 100,000 genes connected end-to-end, with the DNA of each constructed of around 3.3 billion base pairs. The specific DNA sequence is duplicated each time the cell divides. The gene damage responsible for disease occurs because of a point mutation, deletion, translocation or rearrangement in the DNA sequence of normal genes. For example, researchers have found that there can be up to 38 such mutations in the BRCAl gene, which results in an 85% chance of developing breast cancer. The fact that all genes are first assembled, and then connected together in the DNA strand, by natural electrostatic fields within the cell points to the real possibility that electrostatic fields exerting influence from sources outside the body may be able to alter the force of the bodies natural electrostatic fields enough to cause a miss, or missed, connection as the DNA strand is assembled.

III. Biological Degradation Theory

The following theoretical discussion is offered in an effort to aid in understanding and practicing the invention. However, it must be recognized that our knowledge of cellular operation at the molecular level is incomplete. The theoretical discussions contained herein are therefore not intended to be limiting on the invention in any manner.

The findings of the inventor's studies involving electrostatic field influence inside living tissue are surprising and not predicted. As shown by Gauss's law, there can be only zero electric field inside a conductive object in static equilibrium. It has therefore been easy to assume that the conductive nature of a mammalian body acts as any simple conductive object, with external electrostatic fields causing polarization and a shift in charges to achieve a point of equilibrium resulting in zero field influence inside the object. The inventor's study findings demonstrate that a mammalian body reacts with an electrostatic field in a much different way than with a simple conductive object. In retrospect, Gauss's law actually points to this because a mammalian body is known to contain and use countless continually changing internal electric fields as it constantly adds, releases, binds, and moves charged molecules to cause and control normal cell operations. It therefore cannot be considered to be a simple conductive body addressed by Gauss's law. Also a mammalian body is highly nonhomogeneous and not a perfect, or uniform, electrical conductor. In fact the electrical resistivity of mammalian tissue varies enough that electrical impedance tomography is now being developed as a non-invasive imaging and diagnostic method It may be that one, or a combination, of these two factors is the key to the electrostatic field effects in the inventor's animal studies. The dynamic nature, and nonuniform conductivity, of a mammalian body may prevent the body from ever reaching a point of true static equilibrium. Therefore an imposed electrostatic field would not fall to zero at the surface as it would for a simple static conductive object. The electrostatic field would of course be reduced, but unless it drops to zero it could attract or repel normal cell charges and fields inside the body enough to affect cell operation.

As a direct example, the circulatory system continuously moves ionic fluid through the space between cells. Although the bulk of this movement can be relatively fast, it is known that a layer of fluid, which can extend 50 $\mu$m or more out from cell membranes, remains almost "unstirred". Ions influenced by the applied electrostatic field to slightly move from the bulk fluid to this stagnant layer would accumulate there, and would be very close to the cell membrane. Their combined field influence could then alter the existing transmembrane potential and surface charge density, thus opening a number of possibilities for reaction, migration of cell surface macromolecules, and transport of material across the lipid bilayer. It is likely that the electrostatic field influence applied to molecules of the moving interstitial fluid would be extremely small. However, movement of ions from the bulk fluid to the stagnant layer next to cell membranes would be accomplished by changing the direction of the velocity of the ions without directly changing the magnitude of the velocity. Thus no expenditure of energy (work) would be required from the field.

It is also known that the effect of migration of cell surface macromolecules may be transferred to the cell nucleus via microtubules and intermediate filaments spanning to the nucleus from many of these molecules. This identifies another danger from exposure to electrostatic fields. We now believe that almost all cancer is the result of a mutation in cellular DNA. As a cell prepares to divide, its DNA is duplicated so the original and progeny cells both end up with DNA strands. Cell cycle times vary, but consider a rather common time of 27 hours between cell divisions. During this period the cell goes through four phases in preparation to divide. DNA is replicated during the S phase of the cycle, in this case a time interval around 10 hours. During this period over 100,000 genes are moved from compartments in the cell and assembled, in the proper end-to-end sequence, to form the duplicate DNA strand. This is a high speed assembly line driven by natural electric charges and fields within the cell, and also the DNA is held together by natural electric charges. An unnatural electrostatic field influence (and that is what the inventors studies have demonstrated) could result in a miss, or missed, connection in the DNA strand. Of additional interest, it has been speculated that the majority of all major noninfectious disease is the result of DNA abnormalities. This includes a broad range of disease types, from Alzheimer's to obesity for example.

IV. Environmental Electrostatic Fields

The inventor's in vivo studies leave little doubt that electrostatic fields can promote cancer growth. There is also reason to believe these fields may be able to initiate cancer, either by directly causing DNA damage, or by increasing the effect of environmentally encountered chemicals on cells. Protecting body areas known to be particularly susceptible to damage, such as the female breast, from uncontrolled exposure to these fields is very important. Yet, our modern world has created an environment that favors generating and holding the static charges that create these fields. The United States has led the world in the increasing use of synthetic materials in our clothes and on other surfaces around us, and these are the dominant materials with which we now live. Polyester, nylon, acrylic and polyolefins, for example, are much better static charge generators than natural fibers. Also, unlike natural fibers, synthetic materials are hydrophobic and do not wick moisture from the air, or our skin, to provide conductive paths through which the charges can drain. In addition, over the past 20 years, the United States has led the world in the increasing use of air conditioning. This keeps the humidity of our environment low and favors the generation and holding of static charges over long periods of time. Humans are therefore almost constantly exposed to electrostatic fields from both our clothes and other surfaces around us.

As an example, the inventor has measured electrostatic charges generated by various activities at 50% relative humidity, and has found for example that removing a nylon jacket, while wearing a polyester shirt can leave a 1,980 volt charge on the center of the shirt's front surface, and a 6,000 volt charge on the center of the shirt's rear surface; that removing a rayon lined jacket, while wearing a silk blouse, can leave a 600 volt charge on the center front of the blouse, and a 4,300 volt charge on the center back of the blouse; and that getting up from between two cotton bed sheets while wearing polyester pajamas can leave a 3,100 volt charge on the front center chest area of the pajamas, and a 4,600 volt charge on the back center of the pajamas.

The fact that these electrostatic charges are typically very close to the garment wearer's body exposes the body to very strong electrostatic fields. For example the inventor has demonstrated that rubbing a polyester blouse against a nylon bra can easily generate over 5,000 volts of electrostatic charge that can be less than 0.5 mm from the breast. A 5,000 volt electrostatic charge of just 1-cm diameter, 0.5-mm from the breast, exposes the breast tissue to an electrostatic field intensity over 900,000 V/m. This is a field 3 ½ times stronger than the field the animals in the following Study Example D were exposed to.

Without doubt, electrostatic charges ranging from hundreds to thousands of volts are almost always present on the surface of clothes we are wearing, and on surfaces we are rubbing against, even under relatively high humidity conditions. Charges on human skin are not of concern because they are able to disperse or drain along the relatively conductive surface of the skin, whereas charges generated on the surface of clothes, plastic covered chairs, etc. are trapped on the relatively nonconductive surface of the material. These charges can remain in place very near the body, with their electrostatic fields connecting to the body, for hours at a time.

SUMMARY OF THE INVENTION

The present invention is directed at protecting the breast area from detrimental influence from electrostatic fields by the use of specially constructed bras that react to impinging electrostatic fields by creating ions in the air that move to cancel electrostatic charges creating the detrimental field. Bras in the present invention utilize electrically conductive electrostatic field-concentrators (sometimes referred to herein simply as "field-concentrators" or "concentrators", or "concentrator"), at spaced-apart locations that operate to generate ions in the air that then move to cancel electrostatic charges in the vicinity. A conductive body, or bodies, comprising a plurality of field-concentrators exists on or within the structure of the bra. The field-concentrators are formed as a plurality of spaced-apart salient areas on one or more conductive bodies of material, on or within the structure of the bra. Outermost boundaries of each concentrator are characterized by a surface, typically a end, terminating at a distance at least greater than, and preferably 2 times or more greater than, the axial radius of the largest cross-sectional width of the concentrator body. In an alternate method, the ends of the concentrators are salient from the surface of the bulk of the conductive material by a distance at least greater than, and preferably 2 times or more greater than, the axial radius of the bulk of the conductive material at the immediate surface the concentrator is salient from.

These field-concentrators attract impinging electrostatic fields to preferentially connect with the conductive material of the concentrators. This causes the fields to crowd closely together on the concentrators, which in turn increases the field intensity to a point that causes nearby air molecules to separate into positive and negative ions. The ions carrying a charge opposite that of the charges generating the electrostatic field are then attracted to those charges, and the ions combine with and cancel the electrostatic charges generating the field. Thus bras under the invention can stop electrostatic fields at their source even if the source is not directly on the material of the bra, but is instead on another surface such as a blouse for example. This can help protect both tissue covered by the structure of the bra, and also even adjacent tissue not covered by the bra, from detrimental influence from these fields. This is important because many popular bra designs do not cover all of the breast tissue.

Bras in a preferred method of the invention will be principally formed from nonconductive material for comfort and low cost, but will incorporate a plurality of conductive electrostatic field-concentrators at spaced-apart locations. The nonconductive material may be any material suitable to construct bras or other breast coverings of the desired design. Such materials are well known in the garment industry, and examples would include fabrics as well as nonwoven, molded, cast, and extruded materials. Bodies of conductive material comprising electrostatic field-concentrators may be incorporated on or within the nonconductive material of the bra. In some methods of the invention, the bodies of conductive material comprising electrostatic field-concentrators may be supported by nonconductive material placed on or within the bra.

The inventor has used in vivo studies to conclusively demonstrate that electrostatic fields can exert strong influence inside a living body, directly affecting cell operation and also strongly increasing the detrimental effect of chemicals on cells. Protecting the female breast area, which is particularly prone to cell damage, from these fields is very important. This can result in reduced breast disease, and lives saved.

OBJECTS AND ADVANTAGES

Accordingly, the method of the present invention has several objects and advantages. For example:

(a) to provide, for women in general, inexpensive, comfortable, and non-obtrusive breast support garments which can minimize detrimental effects on tissue caused by exposure of the breast area to electrostatic fields;

(b) to aid women who have already been a victim of breast disease in protecting their breast area from detrimental effects caused by exposure to electrostatic fields. In this regard, bras constructed under the methods of the present invention can be particularly important for women who have undergone partial or complete mastectomy because of their high risk of a return of disease.

(c) to aid people who have a familial predisposition to breast disease in protecting their breast area from detrimental effects caused by exposure to electrostatic fields.

(d) to minimize the ability of electrostatic fields to increase the detrimental effect of environmentally encountered chemicals on breast area tissue.

These objects, as well as other objects which will become apparent from the discussion that follows are achieved, according to the present invention, by providing specially constructed breast or breast prosthesis support articles, or other coverings such as brassiere inserts for example, herein collectively referred to as bras, which react to impinging electrostatic fields by creating air ions to cancel electrostatic charges on the bra, and also on other surfaces in the vicinity, to protect breast area tissue from detrimental electrostatic field influence.

BRIEF DESCRIPTION OF THE DRAWINGS

In the following drawings, which form a part of the specification and which are to be construed in conjunction therewith, and which like reference numerals have been employed throughout wherever possible to indicate like parts in the various views:

FIG. 13 is an enlarged fragmentary sectional view of the grid and concentrators of FIG. 12;

FIG. 14 is an elevational view of a preferred insert comprising concentrators for placement in a standard bra breast cup;

FIG. 15 is a sectional view taken along the center of the bra insert of FIG. 14;

FIG. 16 is an enlarged cross-sectional view of a shard comprising concentrators suitable for use in the insert of FIG. 14;

FIG. 17 is a fragmentary, diagrammatic view illustrating characteristics of one type of preferred concentrator; and FIG. 18 is an enlarged, fragmentary sectional view taken generally from position 18—18 in FIG. 4.

DETAILED DESCRIPTION

Figure 1:
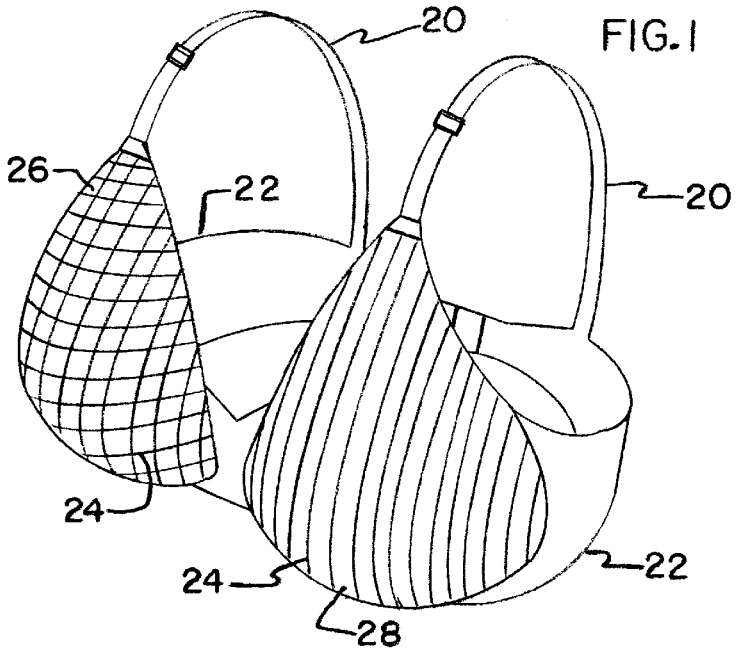
FIG. 1 is a perspective view of a bra constructed in accordance with the invention, wherein the right breast cup comprises filaments comprising concentrators arranged in a grid and the left breast cup utilizes parallel filaments comprising concentrators, and wherein the spacing between adjacent filaments is exaggerated by enlargement for clarity.

Referring now to the drawings, FIG. 1 shows a perspective view an example of a preferred bra embodiment incorporating filaments comprising electrostatic field-concentrators defined at spaced locations within or on the standard weave or knit of a fabric. The bra typically comprises shoulder supports 20, side portions 22 extending to the back, and breast receiving cups. As a cost saving method, the filaments comprising field-concentrators 24 are applied in a pattern instead of as a solid surface. Although the same pattern of filaments would commonly be used in both breast receiving cups, two pattern examples are show here, with the right breast receiving cup 26 showing the filaments in a grid, and the left breast receiving cup 28 showing the filaments in parallel lines. If the spacing used for filaments 24 is larger than about 4-mm, a grid pattern is more preferred because it provides more concentrators. In a preferred embodiment, filaments 24 will be approximately the same diameter as the nonconductive filaments forming the weave or knit of the fabric. However, filaments 24 may be a smaller diameter if it is desirable to camouflage the filaments, or larger diameter if it is desirable to plainly shown the filaments, in the nonconductive filaments forming the weave or knit of the fabric. Also in a preferred embodiment, the majority of the filaments comprising concentrators will have at least one path of electrical connection with the wearer's body. This helps the concentrators ionize air molecules to cancel electrostatic charges in the vicinity and minimize detrimental electrostatic field influence on the wearer's breast area. The spacing between the filaments comprising concentrators is preferably around 1 to 10-mm, with about 6-mm or less more preferred, but is shown enlarged for clarity. Also, the filaments are shown only in the breast cups, but can also be beneficially used in other portions of the bra. Several types of filament comprising concentrators are suitable for use in the bra, and the type chosen will depend to a great extent on the production capabilities of the manufacturer and desired cost of the bra. Examples of suitable filaments include those shown in the following figures.

Figure 2:
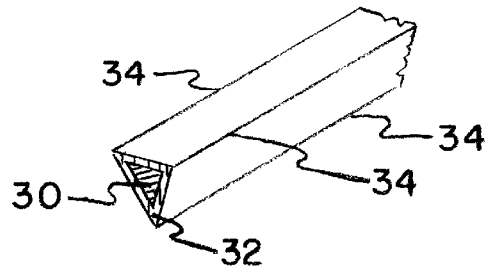
FIG. 2 is a fragmentary perspective, sectional view of a conductive filament comprising nonconductive material, conductive material, and field-concentrators.

FIG. 2 shows a fragmentary portion of an example of a conductive filament comprising concentrators suitable for use in the fabric of the bra of FIG. 1. A core of nonconductive material 30 is coated with a conductive material 32, such as carbon black for example, with the shape forming concentrators as ridges 34 along the length of the filament.

Figure 3:
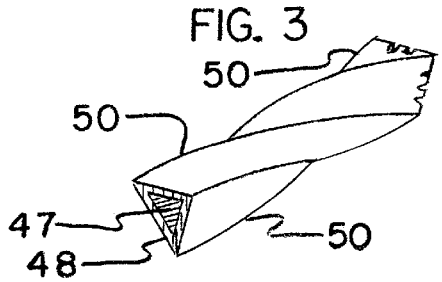
FIG. 3 is a fragmentary, perspective cross-sectional view of an alternative filament comprising a nonconductive core coated with conductive material to form concentrators.

FIG. 3 shows a fragmentary portion of another example of a conductive filament comprising concentrators suitable for use in the fabric of the bra of FIG. 1. This filament is similar to that of FIG. 2 but more preferred, with a core of nonconductive material 47 coated with a conductive material 48, with the shape forming concentrators as ridges 50 along the length of the filament. The resulting filament is rotated (twisted) about its axis so that the ridges 50 forming the concentrators wind around the filament. This enhances the ability of the concentrators to ionize air molecules and cancel electrostatic charges by insuring that one of the concentrators is always directed toward the area generating electrostatic fields.

Figure 4:
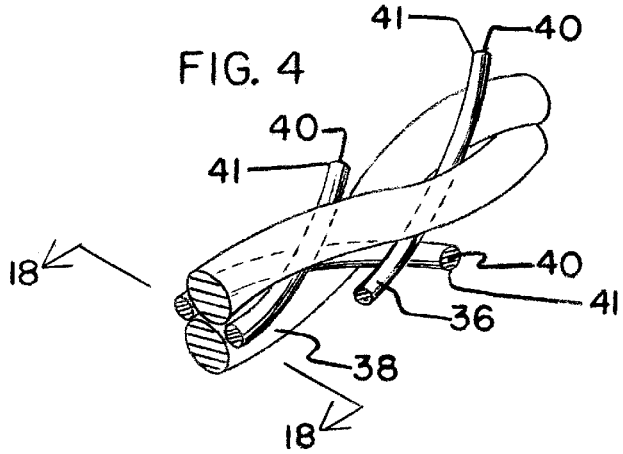
FIG. 4 is a fragmentary, perspective cross-sectional view of a preferred filament in which lengths of conductive material comprising concentrators are twisted with nonconductive material.

FIG. 4 shows a fragmentary portion of a preferred example of conductive filament comprising concentrators suitable for use in the fabric of the bra of FIG. 1. In this example, short lengths of fine conductive strains 36 are twisted along with at least one nonconductive filament 38 to form a larger filament body with a conductive element running through it. Each concentrator 40 occurs at spaced-apart locations along the length of the larger filament body. The body of each concentrator 40 has a surface that is salient from the surface of the bulk of the conductive material of the filament by a distance at least greater, and preferably 2 times or more greater than the axial radius of the largest cross-sectional width of the concentrator. The electrostatic field concentration is generally strongest on the concentrator at the concentrator surface most distance from the conductive bulk of the filament. This distance is preferably at ends 41 of the conductive strands 36.

To demonstrate a currently preferred embodiment of a bra under the invention, the inventor twisted 50-mm long conductive strands, of 3 denier, carbon black coated acrylic, together with nonconductive strands of acrylic to form a continuous filament of about 80 denier. The conductive strands were used a concentration of about 10% of the filament, and the conductive strands were staggered so the majority were in electrical connection with each other. A plurality of the conductive strand ends were positioned to be salient from the electrically connected bulk of the strands, and also occur at an average of around 6-mm or less of the filament length to insure the generation of a large number of air ions in the presence of impinging electrostatic fields. The completed filament was then placed as parallel lines 3.5 -mm apart in the weave of a common polyester fabric. The polyester fabric/filament combination was then used to construct a bra cup similar to that shown in the left bra cup of FIG. 1.

To test the ability of the bra cup to protect a wearer from electrostatic fields, a 19-mm wide by 125-mm long piece of polyester plastic was electrically charged to voltages ranging from 5,000 to 15,000 volts. An electrostatic field meter was then placed in the bra cup (to serve as breast tissue), and the cup has held next to the charged plastic to determine how well the bra cup construction prevented electrostatic fields from reaching the meter (breast tissue). At all voltages, the bra cup would reduce the field influence by 100% in less than two seconds. Also the tests demonstrated that the bra cup could cancel electrostatic electric charges over 25-mm away. This demonstrated the ability of the bra cup to protect not only the breast area covered by the cup, but also large areas around the cup. This is important because many popular bra designs do not cover all of the breast tissue.

Another suitable, but more expensive, method of producing this type of larger filament is to replace nonconductive filament 38 with a conductive material. In a variation of this, filament 38 may be a conductive material of lower resistivity, such as metal-coated plastic for example, with conductive strands 36 being a conductive material of higher resistivity, such as hygroscopically conductive cellulose for example. Also, a mixture of lower resistivity material and higher resistivity material may be used for conductive strands 36. Although filament 38 and strands 36 are shown round, the invention is intended to also include a substantially flat surface of lower resistivity conductive material placed adjacent a substantially flat surface of higher resistivity conductive material comprising concentrators.

Figure 5:
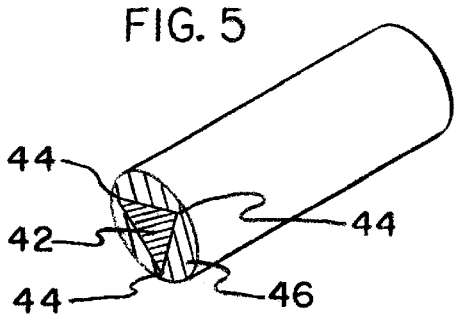
FIG. 5 is a fragmentary, perspective cross-sectional view of an alternative filament incorporating conductive material inside a nonconductive covering.

FIG. 5 shows another example of filament comprising concentrators suitable for use in the fabric of the bra of FIG. 1. In this example, the filament comprises a conductive material 42 formed with concentrators 44 as ridges inside a nonconductive covering 46. Twisting concentrators 44 around the axis of the filament as noted in FIG. 3 above is also desirable. Nonconductive material 46 protects conductive material 42 from damage. This type of filament is not conductive along the outside surface, and the conductive material comprising concentrators will generally not make electrical connection with the wearer's body. The concentrators may therefore sometimes be slower to ionize air molecules and cancel electrostatic charges, and are therefore not as preferred as the examples shown in FIGS. 2, 3, and 4.

Figure 6:
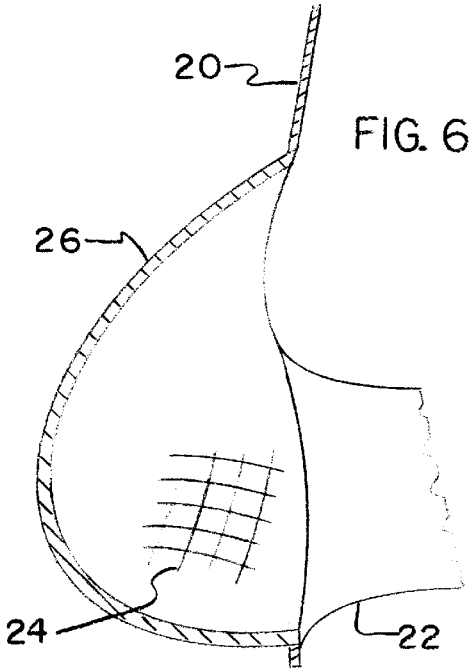
FIG. 6 is a fragmentary sectional view of a bra breast cup showing conductive filaments comprising concentrators that make electrical connection with the wearer's body.

FIG. 6 sectionally shows breast cup 26 in FIG. 1, with a shoulder support 20 extending up, and a side portion 22 extending to the back. One method of having filaments comprising concentrators 24 in electrical connection with at least one point of the wearer's body is shown, with the grid of filaments 24 extending through the weave of the bra so that at least some of them make electrical connection with the wearer's body. Only a small area of the grid of filaments comprising concentrators is shown for clarity. Also note that filaments 24 do not have to have electrical connection with the breast of the wearer in the preferred method, just with the wearer's body. This means the electrical connection could be made anywhere, for example on shoulder support 20 or side portion 22 if conductive material is included in one of these areas to contact the wearer's body and is also electrically connected to filaments 24 in the breast receiving cups.

Figure 7:
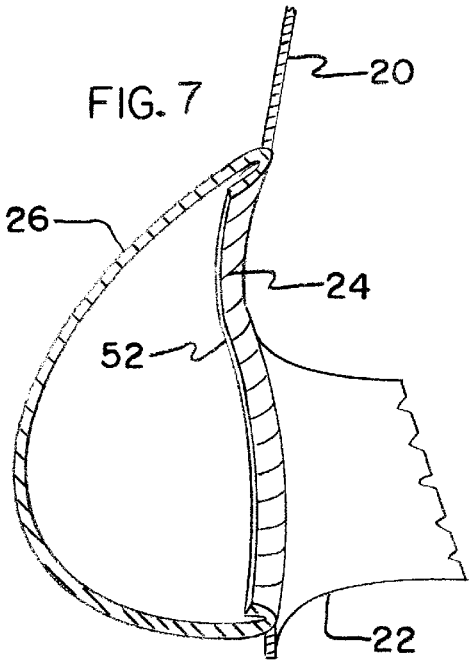
FIG. 7 is a fragmentary sectional view of an alternative breast cup showing in-turned fabric with conductive filaments comprising concentrators that make electrical connection with the wearer's body.

FIG. 7 shows another method of having filaments of conductive material comprising concentrators have at least one path of electrical connection with the wearer's body. Again, a side view cross-section taken along the center of a bra right breast cup 26, with a shoulder support 20 and a side portion 22, shown. A seam 52 of the bra is turned under so filaments comprising concentrators 24 on the outer surface of the bra have at least one path of electrical connection with the wearer's body. This method can be useful for example if a particular bra design, or particular fabric type, makes it desirable to place the filaments concentrators on the outer surface of the bra.

Figure 8:
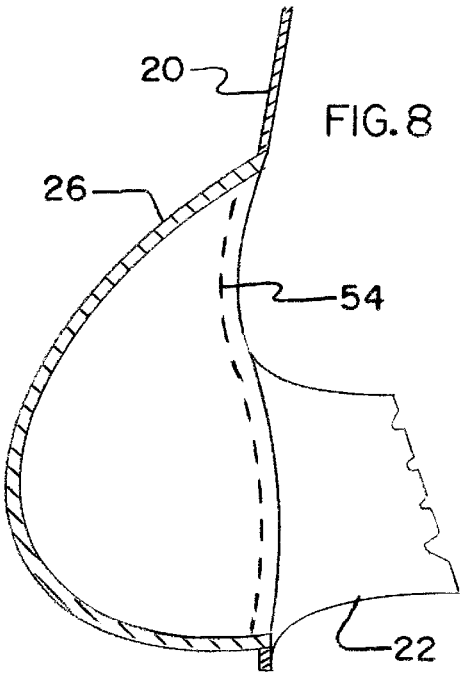
FIG. 8 is a fragmentary sectional view of an alternative breast cup showing conductive filament sewn through the breast cup to make electrical connection between field-concentrators and the wearer's body.

FIG. 8 shows another method of having filaments comprising concentrators make electrical connection with the wearer's body. Again, a side view cross-section taken along the center of a bra right breast cup 26, with a shoulder support 20 and a side portion 22, shown. A filament of conductive material 54 is sewn through the breast cup, connecting from some of the filaments comprising concentrators on the outer surface of the bra to the wearer's body, so at least one path of electrical connection with the wearer's body is established for the concentrators.

Figure 9:
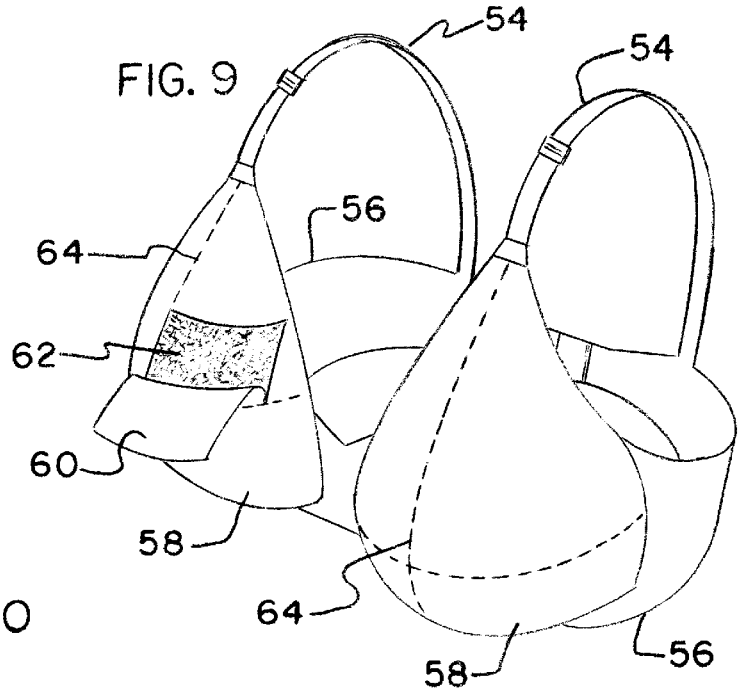
FIG. 9 is a perspective view of a preferred bra comprising concentrators in a liner behind a nonconductive layer.

FIG. 9 shows a perspective view of a bra incorporating concentrators as a liner inside bra cups. This type of bra will typically comprise shoulder supports 54, side portions 56 extending to the back, and breast receiving cups 58. Both breast receiving cups incorporate a liner comprising concentrators, and the outer fabric 60 of the right breast receiving cup is shown peeled down to expose the liner 62. If liner 62 does not make direct electrical connection with the wearers body, filaments of conductive material 64 can be sewn through each breast-receiving cup so that the conductive material of liner 62 has at least one path of electrical connection with the wearer's body. If this type of bra is to be used by a woman who has undergone a mastectomy, liner 62 may be formed as a pouch to hold a breast prosthesis. Such a pouch constructed to include conductive concentrators protects the wearers remaining breast area from electrostatic fields from the outside of the bra, and also from fields generated as the breast prosthesis rubs against the surface of the bra.

Figure 10:
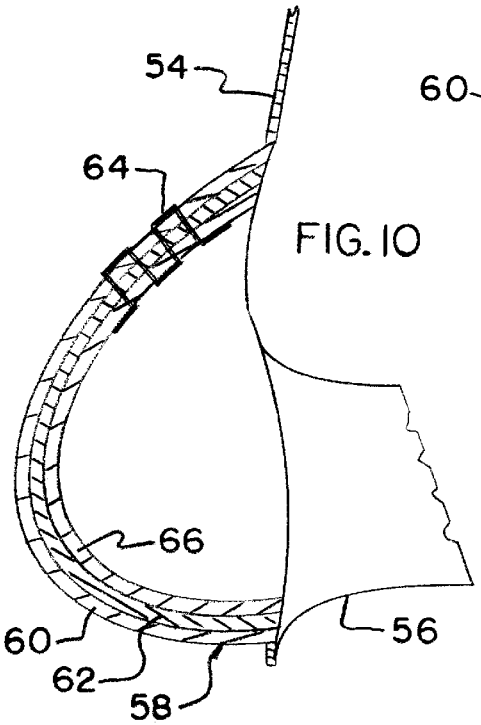
FIG. 10 is a fragmentary sectional view of a breast cup with conductive material comprising concentrators wherein the concentrators occur between two material layers.

FIG. 10 shows an alternative embodiment, comprising shoulder support 54 and a side portion 56, and three layers forming a breast receiving cup 58. In this type of cup, a layer comprising concentrators 62 is sandwiched between nonconductive layers 60 and 66. Numerous forms of material comprising concentrators may be used as layer 62, including for example fabric comprising concentrators similar to those discussed above, and also a padding of comprising concentrators. Nonconductive layer 66 may be omitted to allow layer 62 to directly contact the wearer's body. If layer 66 is included, a filament of conductive material 64 can be sewn through the three layers so that the concentrators 62 have at least one path of electrical connection to the wearer's body. Additional examples of suitable materials for layer 62 are shown in the following figures.

Figure 11:
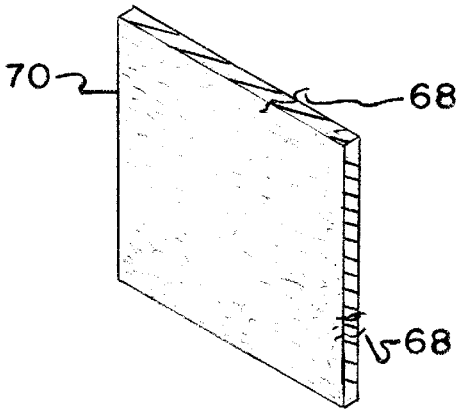
FIG. 11 is an enlarged, fragmentary perspective view showing conductive material comprising concentrators suitable for use as at least one layer in bras described herein.

FIG. 11 shows a portion of a preferred example of one form of a material comprising concentrators suitable for layer 62 in FIG. 10. In this example, fine conductive strands 68 are dispersed in, or are applied to the surface of, a flexible material 70 with the ends of strands 68 serving as concentrators. Only a few conductive strands 68 are shown for clarity. Examples of suitable flexible material 70 include polyurethane foam and nonwoven fabric. Conductive strands 68 are preferably incorporated in a length and quantity that insures that at least one strand end serving as a concentrator is included in around every 6-mm or less of the surface area of material 70, and also preferred that the majority of strands 68 are in electrical connection with each other. Also, it is preferred that at least some of conductive strands 68 have a path of electrical connection to the wearer's body. The salient ends of the conductive strands form concentrators to ionize air molecules and cancel electrostatic charges in the vicinity to prevent detrimental influence of electrostatic fields on the breast area of the wearer. Flexible material 70 serves to hold conductive strands 68 in place, and is also soft and flexible to provide comfort for the wearer.

Figure 12:
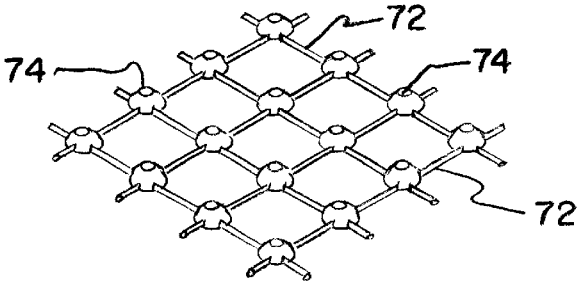
FIG. 12 is an enlarged, fragmentary perspective view of an alternative grid arrangement of concentrators suitable for use according to the invention.

FIG. 12 shows another form of material comprising concentrators suitable for use between nonconductive fabric layers like that in the breast receiving cups of the bra of FIG. 10 for example. In this example flexible polymer is formed in a grid pattern 72, with concentrators 74 formed at spaced locations along the grid at preferably 6-mm. or less spacing from one another. The polymer is then coated with conductive material if it is not intrinsically conductive. In use, the conductive grid (and thus concentrators) would preferably have means for at least one path of electrical connection with the wearer's body.

FIG. 13 shows the grid and field-concentrators 74 of FIG. 12. The section cuts through the center of one of the concentrators and shows nonconductive polymer 76 coated with a layer of conductive material 78, such as doped polypyrole for example. Concentrator 74 starts to extend from the surface of the grid at reference point 75, and has an end 77 that is at least greater than, and preferably 2 times on more greater than, the axial radius of the largest cross-sectional width of the concentrator body. In this case the axial radius of the largest cross-sectional width of the concentrator body is at reference point 75 where concentrator 74 starts to extend from the grid.

FIG. 14 shows an insert for placement in standard bra breast receiving cups so that standard bras can be converted to help protect the wearer's breasts from detrimental electrostatic field influence. The insert comprises shards 80 (or other material such as for example strands) of material comprising concentrators dispersed within, or on, a pliable base 82, such as foam for example, formed to cover at least part of the breast of the wearer. The insert may or may not be preformed in a breast shape. Only a small area of shards 80 is shown for clarity. Each shard 80 has at least one area shaped as an electrostatic field-concentrator. Preferably the majority of shards 80 connect with each other, and also have at least one path of electrical connection to the wearer's body. Also, shards 80 are preferably incorporated in a concentration which insures that at least one concentrator will be present in around each 6 square mm or less of surface area. In an alternate construction, the bra insert may be formed of pliable material and covered on at least one surface with a fabric comprising concentrators (like those discussed in the above Figures for example).

In an example of a bra insert using conductive strands as the conductive material comprising field-concentrating points, the inventor cast a silicone film about 2-mm thick that contained 20% of about 10-mm long, 3 denier, acrylic strands containing carbon black so that a plurality of the strand ends were salient from the of the conductive mass, and were at spaced apart locations. The cured film was then cut so it could be placed in a bra cup. The resulting structure was found to cancel electrostatic charges on both the bra cup and on other nearby surfaces.

FIG. 15 shows one way conductive shards 80 can make electrical connection with the wearer's body. At least some of shards 80 extend from pliable base 82 to make electrical connection with the wearer's body.

FIG. 16 shows an example of a shard 80 comprising concentrators suitable for use in the insert of FIG. 14. Typically in a continuous process, nonconductive material 84 is extruded in a desired shape, chopped (broken, etc.) into shards 80, then coated with conductive material 86. In an alternative method, nonconductive material 84 may be coated with conductive material 86 before it is chopped into shards. In either case, the resulting conductive shape provides concentrators 88 on the surface of each shard. Concentrators 88 are salient from the bulk of the conductive material by a distance at least greater than, and preferably at least 2 times on more greater than, the radius of an imaginary circle placed perpendicular to the longitudinal axis of the conductive material to just touch the outer conductive surfaces.

FIG. 17 diagrammatically illustrates principles associated with a preferred concentrator similar to those shown in FIGS. 2, 3, and 5. FIG. 17 shows a fragment of a filament of conductive material comprising field-concentrators with ends at spaced-apart locations. A reference circle 92 is perpendicular to the longitudinal axis of the illustrated filament, and placed so it just contacts the outer surfaces of the conductive material. The bulk of the filament's mass is within this circle. The field-concentrators 96 extend between the outer periphery of the circle 92 and the ends of corners 98. Concentrators 96 start at tangency points 94. The distance between points 94 and 98, the side length of the concentrator, is greater than the radius 100 of the circle 92. Thus the preferred concentrator has at least one major dimension that exceeds the radius of a circle that circumscribes the bulk of the conductive material from which the concentrator projects. In the best mode the ends 98 of the concentrators are salient (extend) from the immediate surface of the bulk of the axial plane of the electrically connected material by a distance at least greater than, and more preferably 2 times or more greater than, the radius 100 of the imaginary circle 92.

In FIG. 18, another imaginary circle 112 perpendicular to the axis of the filament of FIG. 4 encircles conductive strands to just touch the outer boundaries of conductive strands 36 at a location where a concentrator starts to extend from the main filament body. Concentrator 40, or the end 41 of concentrator 40, extends from the circle 112 by a distance greater than, and more preferably 2 times or more greater than, the radius of the cross-sectional width of the concentrator body. Reference circle 114 indicates the largest cross-sectional width of the concentrator body, with numeral 116 indicating the radius. Thus concentrator 40 projects from circle 112 by a distance at least greater than one-half of the width of the concentrator along it's axis.

This preferred method maximizes the ability of the concentrators to attract impinging electrostatic fields from even low-level nearby electrostatic charges and create air ions that then move to combine with and cancel electrostatic charges generating electrostatic fields.

IN VIVO STUDIES

Before methods for practicing the present invention are discussed, it will be helpful to note the results of examples of the inventor's studies with animals exposed to electrostatic fields, and to electrostatic fields and chemicals in combination. The total scope of the inventor's studies regarding electrostatic field influence inside a living body has involved over 350 tumor bearing rodents, however for the sake of brevity only four such studies will be noted here. The inventor's research protocol used the B6C3F1 mouse strain. This mouse is recognized by the National Cancer Institute as one Standard for chemotherapy research, and is one of the commonly accepted rodent species used in cancer studies. For the inventor's studies, female mice were implanted with murine mammary 16/C adenocarcinoma, a commonly used tumor for cancer research. The 16/C murine mammary tumor is particularly aggressive, and can normally grow from a barely visible, or even invisible, bump under the skin the day after the implant, to 10 to 20 percent of the animal's total body weight by day 14 (tumor size typically up to 4 grams). Approximately equal-sized tumor fragments were implanted in each mouse's axillary region through a puncture in the inguinal region. All test animals were approximately six weeks old, with a body weight of 17 to 20 grams at the time of implant. Also, food and water were provided ad libitum throughout each study, and all Groups were exposed to the same temperature and light conditions (lights on 12 hours and off 12 hours each day). The studies were blinded in both the assignment of the animals to the study groups, and in all tumor measurements.

The first two studies discussed here demonstrate the ability of electrostatic fields to strongly increase the affect of chemical agents inside a mammalian body. After the tumors were allow to establish and grow for several days, the mice were treated with adriamycin (ADM), a commonly used chemotherapeutic agent, at dose levels based on their individual weight and known to be safe. Following this, the animals were blindly divided into the study groups. The growth rate of the tumors in a Control Group, without exposure to electrostatic fields, was compared to that of Test Groups that were under the influence of an electrostatic field. Tumor measurements were made by caliper using the prolate ellipsoid formula of the National Cancer Institute to convert the measurements into weight. This method allowed the tumor weight of each animal to be tracked throughout the study.

The mice in each Test Group were subjected to electrostatic fields with the use of special cages. When the application of electrostatic fields was required, special equipment was used to expose the desired animal groups to an electrostatic field with an intensity of approximately 79,000 V/m from a charged element insulated from the animals.

EXAMPLE A

In the first study noted here, four groups of 11 tumor bearing animal each were used. There was not a statistical difference in the size of the animal tumors at the start of the study. All of the animals were treated with 12 mg/kg ADM on day 4, and housed in cages containing an insulated metal screen suspended 25.4-mm above the animals.

GA: Control, treated with ADM and no electrostatic field exposure. The screen above animals was not charged.

GB: The screen was charged, and changed from positive to negative 15 kV DC once each 15 minutes. This group also had a grounded wire grid below (outside) the cage (90 mm between screen and grid).

GC: The screen was charged 15 kV DC, and changed from positive to negative once each 15 minutes. The animals were on a grounded wire grid cage floor (115 mm between the screen and floor).

GD: The screen was charged, and changed from positive to negative 15 kV once each 15 minutes. There was no ground plane nearby.

Tumor regression caused by the ADM, and the combination of ADM and electrostatic fields is shown below:

GA: −24% tumor wt. loss.

GB: −86% tumor wt. loss.

GC: −80% tumor wt. loss.

GD: −75% tumor wt. loss.

In this study, all of the electrostatic field treated groups achieved significantly higher tumor cell kill than the group treated with ADM only. At three different times during the study, a Leeds and Northrup 0.1 microampere sensitivity meter was used to measure any current flow to ground in the cages. No current flow was detected for any of the groups, confirming that the effects observed were caused solely by exposure to the electrostatic fields. Statically, the study demonstrated p-values as low as 0.001, and odds as high as 8.3 to 1 that an animal in Groups B, C, or D (with field exposure) would have less tumor growth than an animal in Group A (without field exposure).

The findings of this study have hopeful implications, because it may be possible to use electrostatic fields to beneficially increase the affect of chemotherapy in cancer patients, and the inventor is pursuing that possibility. However the findings also have sinister implications. Any external electric field capable of significant influence inside a mammalian body can present a danger. This is demonstrated in the following three studies.

EXAMPLE B

This study used three groups of 11 tumor-bearing animals each. There was not a statistical difference in the size of the animal tumors at the start of the study. All of the animals were treated twice with 8 mg/kg ADM given on days 3 and 5 (16 mg/kg total). In addition, Groups B&C were exposed to an electrostatic field for 4 hours following each injection.

GA: Control, treated with ADM and no electrostatic field exposure.

GB: ADM plus exposure to a negative 15 kV DC charged screen 25.4 mm above, with a grounded grid below, the animals (90 mm between screen and grid).

GC: ADM plus exposure to 15 minute cycles of positive then negative 15 kV DC on a screen 25.4 mm above, with a grounded grid below, the animals (90 mm between screen and grid).

In this study the inventor inadvertently allowed the applied electrostatic fields in Groups B and C to increase the affect of the ADM to a lethal level. All of the animals in this study were treated with the same ADM dose at a level known to be safe, and the animals in GA, without exposure to a static field, incurred no ill affect until day 30 when the affect of the tumor (not the ADM) killed the first animal. The electrostatic fields Groups B and C were exposed to increased the reaction of body cells to the ADM, creating the effect of a lethal overdose. Necropsy revealed obvious heart enlargement of the dead animals in these groups, which is the classic symptom of ADM overdose (irreversible myocardial toxicity with delayed congestive heart failure). In Table 1, "X" indicates an animal death:

TABLE 1

| Day | | Group A | Group B | Group C |
|---|---|---|---|---|
| 0 | Implant all tumors | | | |
| 1 | | | | |
| 2 | | | | |
| 3 | First treatment | | | |
| 4 | | | | |
| 5 | Second Treatment | | | |
| 6 | | | | |
| 7 | | | | |
| 8 | | | | |
| 9 | | | | |
| 10 | | | | |
| 11 | | | | X |
| 12 | | | XXX | XXXXX |
| 13 | | | | |
| 14 | | | | |
| 15 | | | | |
| 16 | | | | |
| 17 | | | | |
| 18 | | | X | |
| 19 | | | X | |
| 20 | | | | |
| 21 | | | | |
| 22 | | | X | |
| 23 | | | | |
| 24 | | | | |
| 25 | | | | |
| 26 | | | | |
| 27 | | | | |
| 28 | | | X | |
| 29 | | | | |
| 30 | | X | | |

ADM is a non-polar molecule, so the applied fields in this study were not directly affecting the chemical, instead the fields were increasing the reaction of the animals' bodies to the chemical. This study demonstrates that externally applied electrostatic fields can react very powerfully with body cells, increasing the response of the body to chemicals. The increased response can be strong enough that a normally well tolerated chemical dose becomes lethal. This has important implications in regard to the ability of electrostatic fields to increase the detrimental affect of environmentally encountered chemicals on cells. In the next two studies discussed here, the inventor exposed tumor-bearing mice to electrostatic fields without treating the mice with ADM.

EXAMPLE C

Two groups of 6 tumor-bearing animals each were used in this study. There was not a statistical difference in the size of the animal tumors at the start of the study. None of the animals were treated with ADM. One of the groups was not exposed to an electrostatic field. The other group was exposed to an electrostatic field from day 2 to 16.

GA: Control, with no field exposure.

GB: Exposed to the field from a 15 kV (negative) charged plate under the cage.

Both groups of animals started the study with approximately the same size tumors, yet by day 16 the tumors in the electrostatic field exposed group were significantly larger than those in the group not exposed to the field:

GA: Median tumor wt. 0.9 g, day 16.

GB: Median tumor wt. 3.2 g, day 16

The group exposed to electrostatic fields experienced an accelerated cancer growth rate over 3.5 times that of the group not exposed to the field. Thus, external electrostatic fields can promote cancer growth inside a mammalian body.

EXAMPLE D

Four groups of 11 tumor-bearing animals each were used in this study, and none of the animals were treated with chemotherapy. There was not a statistical difference in the size of the animal tumors at the start of the study. Groups C and D were exposed to electrostatic fields from static charges generated on the animals' fur as the animals rubbed against a layer of polyester carpet suspended in the cages above the animals. Group B also had the same type of carpet suspended in the cage, but it was treated to generate only low level electrostatic fields. Charges on the animals' fur in each group were measured and averaged 3 times each day.

GA: Low charge generation cage with no carpet suspended above the animals. An average of 63 volts charge was found on the animals' fur during the study.

GB: Carpet suspended above the animals, but the carpet was treated to allow only low-level charge generation. An average of 300 volts electrostatic charge was found on the animals' fur during the study.

GC: Standard carpet suspended above the animals. An average of 1,250 volts electrostatic charge was found on the animals' fur during the study.

GD: Standard carpet suspended above the animals. An average of 2,350 volts charge was found on the animals' fur during the study.

All of the animals started the study with approximately the same size tumors. The study was ended on day 13, and by this time the two groups (C and D) which were exposed to strong electrostatic fields had significantly larger tumor growth than the two groups (A and B) which were exposed to only low level electrostatic fields:

GA: 1,642% median tumor wt. gain.

GB: 1,467% median tumor wt. gain.

GC: 3,459% median tumor wt. gain.

GD: 3,407% median tumor wt. gain.

P-values for Groups C and D, compared to Groups A and B, ranged from 0.01 to 0.007 on the various measurement days. Odds were over 2.5 to 1 that an animal from Groups C or D would have greater tumor growth than an animal from Groups A or B.

The naturally generated electrostatic charges and fields used in this study are identical to those generated as our clothes rub together or against other surfaces, and were well within the range of common charges found on our clothes and other surfaces we rub against (chairs, etc.). This points to the danger we can face each day from these fields. The inventor's animal studies have shown that these fields can detrimentally increase body cell reaction with chemicals, and can also promote cancer growth. With this strong level of influence, there is reason to believe that these fields may also be able to initiate cancer, either directly or by increasing the affect of environmentally encountered chemicals. Summarizing the above study examples, it is clear that:

1. Contrary to common assumptions, exposure to electrostatic fields can exert strong influence inside a mammalian body.

2. Exposure to electrostatic fields can change normal cell operation.

3. Exposure to electrostatic fields promotes cancer growth.

4. Exposure to electrostatic fields makes cells more susceptible to reaction with chemicals inside the body.

5. Protecting particularly sensitive body areas, such as the female breast for example, from exposure to electrostatic fields is important.

METHOD AND MATERIAL EXAMPLES

The inventor's research indicates that environmentally created electrostatic charges are present on surfaces around us more often than not, and that fields from these charges can strongly, and detrimentally, influence cells inside a living body. Protecting breast tissue, which is highly susceptible to damage, from detrimental electrostatic field exposure is very important. The electrostatic fields that most endanger breast tissue come from electrostatic charges in locations close to the breast, for example either directly on a bra surface or on the surface of an outer worn garment such as a blouse or jacket. Bras under the invention minimize electrostatic field influence on breast area tissue by providing a conductive material comprising a plurality of electrically conductive field-concentrators that respond to an impinging electrostatic field by creating air ions that are then attracted to, and cancel electrostatic charges generating the electrostatic fields. The ends of the concentrators are salient, from a point where the concentrator starts to extend from the bulk of the axial plane of the electrically connected material, by a distance at least greater than, and more preferably twice or more greater than, the radius of the bulk of the axial plane of the electrically connected material.

Bras in the present invention can stop electrostatic fields at their source even if the source is not directly on the material of the bra, but is instead on another surface such as a blouse for example. This can help protect both tissue covered by the structure of the bra, and also even adjacent tissue not covered by the bra, from detrimental influence from these fields. This is important because many popular bra designs do not cover all of the breast tissue.

In operation, electrostatic fields in the vicinity of the breast area of the bra wearer are attracted to connect to the conductive material comprising concentrators. This induces charges in the conductive material, and charges having the same polarity as the electrostatic field are repelled through the conductive material away from the field source while charges having a polarity opposite that of the field are attracted toward the field source. Some of the charges attracted toward the field source crowd together at relatively small area presented by the concentrators, and this creates an intense electrical charge at the concentrators. This intense electrical charge then attracts some of the impinging electrostatic fields to crowd together and preferentially connect to the concentrators. This concentrates the electrostatic field influence at the concentrators, and has the effect of locally intensifying the field strength. The intensified field in turn accelerates normal movement of free electrons and ions in the air near the concentrators. The accelerated movement causes the air electrons and ions to crash into air molecules and dislodge additional electrons and ions. Movement of these addition electrons and ions is then accelerated to crash into still additional air molecules, liberating additional electrons and ions. Thus, in typically a fraction of a second, a cascading action occurs which results in many free electrons and ions in the air around the concentrators. The charges carried by these free electrons and ions are in turn influenced by the electrostatic field.

Charges in the air having the same polarity as the source of the electrostatic field are attracted to the concentrators. If the charges stay on the concentrators this can reduce the ability of the concentrators to attract and intensify the electrostatic field, and this is not desirable. One method to avoid this is to have the conductive material carrying the concentrators provide a large enough surface that undesirable charges can flow off of the concentrators and be contained on that surface. Another, and generally more preferable, method to avoid this is to arrange for the majority of conductive material carrying the concentrators to have at least one path of electrically conductive connection with the body of the bra wearer. This allows undesirable charges (having the same polarity as the electrostatic field) to be forced from the conductive material comprising concentrators to the wearer's body (where they either drain off or spread over the body to have no effect) so they are prevented from reducing the charge carried by the concentrators.

Charges in the air having a polarity opposite that of the source of the electrostatic field are attracted to move to the source of the field, where they combine with and cancel charges that are generating the field to minimize the influence of the electrostatic field on the bra wearer.

The term "concentrators" as used herein is intended to include conductive edges, ridges, projections, points and the like, and also irregularly shaped conductive surfaces, that can concentrate electrostatic field force enough to ionize air molecules. As cost saving method, the concentrators will preferably be spaced to occur at least around each 10-mm or less of surface area in at least the breast covering portions of bras. However, an average spacing of one or more concentrators around each 6 square mm or less, of at least the breast covering portions of the bra, is more preferred because it is desirable to provide a high concentration of concentrators to intercept more electrostatic fields and help generate a large number of air ions close to the field source. It is also desirable that the concentrator, or at least the end of the concentrator, have as small a cross-sectional width as possible under the design of a specific desired bra.

The term "conductive" as used herein is intended to mean an ability to quickly move charge carriers, such as electrons or ions, to the field-concentrators in response to an impinging electrostatic field. The material forming the conductive material and the field-concentrators may be any electrically conductive material. Examples include metals, carbon black, durable conductive chemical compounds, hygroscopic materials, or mixtures thereof. However high resistivity slows down the ability of charges to move in the conductive material and accumulate in the concentrators, so conductive materials, or combinations of conductive materials with an effective resistivity around $10^8$ ohm or less from the center of the bulk of the axial plane of the electrically connected material to the end of an adjacent concentrator, at 50% relative humidity, are preferred, and conductive materials with around $10^4$ ohm/centimeter or less resistivity are more preferred. The conductive material chosen for a particular bra design will often depend upon economic factors, such as aesthetics, material cost, or equipment available at a given garment manufacturer for example. The conductive material comprising concentrators may be placed on any surface of, or within, the structure of the bra, or may comprise the bra itself Also, the conductive material comprising concentrators may be incorporated in or on only some portion of the bra, such as for example parallel lines or a grid, or other patterns, to reduce cost, or may present a relatively unbroken surface such as a stratum for example.

Bras under the invention may or may not be electrically conductive across their surface, but will provide a constituent of conductive material comprising concentrators that are capable of transporting electrons (or ions) in response to an impinging electrostatic field. In a preferred embodiment, the plane of material comprising concentrators will cover at least a portion of the breasts of the wearer, but may also be beneficially included in any back and shoulder straps, and in any torso covering if the bra comprises a bustier, chemise, or similar garment design. Also in a preferred embodiment the concentrators have at least one path of electrical connection with the body of the bra wearer.

In another method of the invention, the bra will comprise concentrators, which do not have electrical connection with the wearer's body. This method is not most preferred, but can be used in bra designs where it is inconvenient or impractical to establish conductive electrical connection between the concentrators and wearer's body. In this method, the concentrators may not be as consistently able to maintain an optimum charge, to generate a maximum number of air ions, as is the preferred method. Thus, this method may sometimes be slower than the preferred method to cancel electrostatic charges and minimize the generation of electrostatic fields.

Cost and comfort will generally dictate the use of nonconductive material and conductive material in various combinations in bras under the invention. The term "nonconductive material" in this context is intended to mean any material, fabric, etc., which is not electrically conductive in the invention, and can be used to form a bra, or sections of a bra. The nonconductive material will most often be woven or knitted from filament, fiber, thread, yarn, or strands. The term "filament" used herein is intended to mean any of these or other lengths of material, and these terms are also intended to be interchangeable.

Examples of currently preferred methods will be given here to help in the design of bras under the invention. In an example of a preferred bra embodiment, a plurality of short conductive strands are twisted together with nonconductive filament, with a plurality of the strand ends positioned to be salient from the electrically connected bulk of the strands. This creates a filament suitable for weaving or knitting along with common filament into a fabric. The conductive strands may be crimped in several locations to help them remain in place in the twisted filament, or if needed an adhesive, such as Thread Fuse™ for example, may be twisted along with the other components to hold the filament together. The resulting filament is then placed in or on woven or knitted fabric that will be used as part of the bra construction.

The conductive strands can be any length to meet the needs of a specific bra design, however it is usually preferred that they are around 90-mm long or less, but more preferred that the conductive strands are 50-mm long or less so the conductive strand ends salient from the electrically connected bulk presented by the conductive strands provide a great number of concentrators along the length of the filament. Although the filament may be produced completely from conductive strands, some of which have their ends salient to provide concentrators, it generally saves cost to combine conductive strands along with nonconductive strands. In this regard, it is preferred that the conductive strands be placed in the filament at concentrations of around 1% to 50%, but more preferred that the conductive strand concentration be around 20% or less of the filament to save cost.

The diameter of the conductive strands comprising concentrators will typically be around 0.5 to 20 denier, with 8 denier or less more preferred because smaller diameters can more strongly concentrate charges at the concentrator location, and thus more strongly concentrate electrostatic fields there to produce a large number of air ions.

In above preferred example, the electrically connected bulk of the conductive strands serve as a conductive material running the length of the filament, and the ends of the conductive strands salient from that bulk act as good concentrators. The conductive strand length is not critical as long as the length, concentration, and staggering is such that the desired number of salient conductive ends occurs along the filament length, and the method and production equipment chosen will typically be used to control this. It is also preferred that the conductive strand lengths are used in sufficient concentration that the majority of them are in electrical connection with each other. In addition, it is preferred that the majority of the conductive strands have at least one path of electrical connection with the wearer's body, either directly or through other conductive strands or means.

Sterling Fibers, Pace, Fla., can supply 3 denier acrylic strands about 37-mm long which contain conductive carbon black. Other conductive strand types, such as plastic strands coated with metal for example, which are known in the industry, may also be used as conductive material comprising field-concentrators. In addition, combinations of materials having low resistivity and high resistivity may be used. An example of this is a filament constructed with one or more low resistivity strand, such as metal coated plastic, which is known in the industry, for example, and twisted with shorter strands of a higher resistivity material, such as hygroscopically conductive cellulose for example. The low resistivity strains provide a low resistivity conductive material running the length of the filament and this increases the effective conductivity of the hygroscopically conductive cellulose strands because they are in close contact with the lower resistivity strands. The salient ends of the hygroscopically conductive cellulose strands provide concentrators along the length of the filament, preferably at a spacing 6-mm or less, and more preferably 3-mm or less between the ends if the target cost of the bra will allow that.

The resulting filament comprising concentrators in the above example is placed along with nonconductive filaments to form a woven or knitted fabric. The filament comprising concentrators is placed as a grid with a spacing preferably around 3-mm (if the target cost will allow that). The fabric can be used to construct a bra cup, or a bra cup lining. The fabric can also be used to cover at least one surface of an insert for a common bra cup to help convert the common bra to protect against detrimental electrostatic field influence.

Although the description above contains many specificity's, these should not be construed as limiting the scope of the invention but as merely providing illustrations of some of the presently preferred embodiments of this invention. For example, a bra under the invention may have only one large cup to receive both breasts together, instead of two breast receiving cups, or one or both breast cups may be formed to hold a breast prosthesis. Also, other equivalents of the materials and methods shown may be used. Thus the scope of the invention should be determined by the appended claims and their legal equivalents, rather than the examples given.

What is claimed is:

1. A breast support article adapted to be worn by a wearer, the article comprising:

at least one generally breast shaped cup comprising at least one layer of a material, said generally breast shaped cup comprising an electrically conductive portion formed of a plurality of filaments comprising both conductive and nonconductive strands;

said conductive strands comprising a plurality of electrostatic field-concentrators, projecting from the electrically conductive strands, upon which at least some electrostatic fields impinging on said breast shaped cup connect to ionize air molecules, thereby canceling electrostatic charges in the vicinity; and, whereby the breast support article protects at least part of the breast area of the wearer from detrimental influence from electrostatic fields.

2. The breast support article of claim 1 wherein a plurality of said electrostatic field-concentrators projects from a hypothetical circle that circumscribes the axial cross-sectional bulk of said conductive strands from which said electrostatic field-concentrators project by a distance greater than one-half of the largest cross-sectional width of the electrostatic field concentrator along it's axis.

3. The breast support article of claim 1 wherein a plurality of conductive filaments comprising conductive strands comprising electrostatic field-concentrators are included instead of a plurality of filaments comprising both conductive and nonconductive strands.

4. A breast support article adapted to be worn by a wearer, the article comprising:

at least one generally breast shaped cup comprising at least one layer of a material;

said generally breast shaped cup comprising an electrically conductive portion;

said electrically conductive portion comprising a plurality of spaced-apart electrostatic field-concentrators, projecting from the electrically conductive portion, upon which at least some electrostatic fields impinging upon the breast support article concentrate to ionize air molecules, thereby canceling electrostatic charges in the vicinity; and, whereby the breast support article protects at least part of the breast area of the wearer from detrimental influence from electrostatic fields.

5. The breast support article of claim 4 wherein a plurality of said electrostatic field-concentrators comprise at least one major dimension that exceeds the radius of a hypothetical circle that circumscribes the axial cross-section of the bulk of a conductive portion from which said electrostatic field-concentrators project.

6. The breast support article of claim 4 wherein a plurality of said electrostatic field-concentrators project from a hypothetical circle, that circumscribes the axial cross-sectional bulk of said conductive portion from which said electrostatic field-concentrator projects, by a distance greater than one-half of the largest cross-sectional width of an electrostatic field-concentrator along it's axis.

7. The breast support article of claim 4 wherein said electrostatic field-concentrators are located substantially externally of at least a portion of the breast support article.

8. The breast support article of claim 4 wherein said electrostatic field-concentrators are located substantially internally of at least a portion of the breast support article.

9. The breast support article of claim 4 wherein said electrostatic field-concentrators are dispersed within a nonconductive material.

10. The breast support article of claim 4 wherein said electrically conductive portion comprising a plurality of spaced-apart electrostatic field-concentrators comprises a stratum.

11. The breast support article of claim 4 wherein said electrically conductive portion comprising a plurality of spaced-apart electrostatic field-concentrators are incorporated as a pattern along with a nonconductive material.

12. The breast support article of claim 4 wherein said electrically conductive portion comprising a plurality of spaced-apart electrostatic field-concentrators comprises a filament.

13. The breast support article of claim 4, wherein said electrically conductive portion comprising a plurality of spaced-apart electrostatic field-concentrators comprises a shard.

14. The breast support article of claim 4, wherein said electrically conductive portion comprising a plurality of spaced-apart electrostatic field-concentrators makes at least one point of direct electrical connection with the wearer.

15. The breast support article of claim 4, wherein said electrically conductive portion comprising a plurality of spaced-apart electrostatic field-concentrators does not make direct electrical connection with the wearer, but wherein means for at least one path of electrical connection between said electrically conductive portion comprising a plurality of spaced-apart electrostatic field-concentrators and the wearer is provided.

16. The breast support article of claim 4, wherein said electrically conductive portion comprising a plurality of spaced-apart electrostatic field-concentrators is not in direct electrical connection with the wearer.

17. The breast support article of claim 4, wherein at least one said generally breast shaped cup is formed to hold a breast prosthesis.

18. An insert for a breast support article breast-receiving cup for covering at least a portion of a body part of a wearer, comprising:

a pliable layer configured for placement in said breast support article breast-receiving cup for covering at least a portion of a breast area of said wearer, with;

at least a portion of said pliable layer comprising a portion of electrically conductive material comprising a plurality of spaced-apart electrostatic field-concentrators projecting from the electrically conductive portion, upon which at least some electrostatic fields impinging upon the insert concentrate to ionize air molecules to cancel electrostatic charges in the vicinity; and whereby the insert for a breast support article breast-receiving cup protects at least part of the breast area of the wearer from detrimental influence from electrostatic fields.

19. The breast support article insert of claim 18 wherein a plurality of said electrostatic field-concentrators comprise at least one major dimension that exceeds the radius of a hypothetical circle that circumscribes the axial cross-section of the bulk of a conductive portion from which said electrostatic field-concentrators project.

20. The breast support article insert of claim 18 wherein a plurality of said electrostatic field-concentrators project from a hypothetical circle, that circumscribes the axial cross-sectional bulk of said conductive portion from which said electrostatic field-concentrators project, by a distance greater than one-half of the largest cross-sectional width of an electrostatic field-concentrator along it's axis.

21. The breast support article insert of claim 18, wherein said electrostatic field-concentrators are located substantially external of at least a portion of the insert.

22. The breast support article insert of claim 18, wherein said electrostatic field-concentrators are located substantially internal of at least a portion of the insert.

23. The breast support article insert of claim 18, wherein said electrostatic field-concentrators are dispersed in a nonconductive material.

24. The breast support article insert of claim 18, wherein said electrically conductive portion comprising a plurality of spaced-apart electrostatic field-concentrators comprises a stratum.

25. The breast support article insert of claim 18, wherein said electrically conductive portion comprising a plurality of spaced-apart electrostatic field-concentrators is incorporated as a pattern along with a nonconductive material.

26. The breast support article insert of claim 18, wherein said electrically conductive portion comprising a plurality of spaced-apart electrostatic field-concentrators comprises a filament.

27. The breast support article insert of claim 18, wherein said electrically conductive portion comprising a plurality of spaced-apart electrostatic field-concentrators comprises a shard.

28. The breast support article insert of claim 18, wherein at least some of said electrically conductive portion comprising a plurality of spaced-apart electrostatic field-concentrators makes at least one point of direct electrical connection with the wearer.

29. The breast support article insert of claim 18, wherein said electrically conductive portion comprising a plurality of spaced-apart electrostatic field-concentrators does not make direct electrical connection with the wearer, but wherein means for at least one path of electrical connection between said electrically conductive portion comprising a plurality of spaced-apart electrostatic field-concentrators and the wearer is provided.

30. The breast support article insert of claim 18, wherein said electrically conductive portion comprising a plurality of spaced-apart electrostatic field-concentrators is not in electrical connection with the wearer.

* * * * *